US011465262B2

(12) United States Patent
Barker

(10) Patent No.: US 11,465,262 B2
(45) Date of Patent: Oct. 11, 2022

(54) BLADE SHARPENER DEVICE

(71) Applicant: Andrew Ross, Kingston (AU)

(72) Inventor: Robert John Barker, Perth (AU)

(73) Assignee: Andrew Ross, Kingston (AU)

( * ) Notice: Subject to any disclaimer, the term of this patent is extended or adjusted under 35 U.S.C. 154(b) by 287 days.

(21) Appl. No.: 16/896,789

(22) Filed: Jun. 9, 2020

(65) Prior Publication Data

US 2020/0391353 A1 Dec. 17, 2020

(30) Foreign Application Priority Data

Jun. 14, 2019 (AU) ..... 2019902069

(51) Int. Cl.
*B24D 15/06* (2006.01)
*B24D 15/08* (2006.01)

(52) U.S. Cl.
CPC ..... *B24D 15/065* (2013.01); *B24D 15/084* (2013.01)

(58) Field of Classification Search
CPC .... B24D 15/084; B24D 15/06; B24D 15/063; B24D 15/065; B24D 15/08; B24D 15/085
USPC ..... 451/380, 367–371, 378, 377, 319, 321, 451/322, 320, 45, 555, 556; 76/82, 82.2, 76/88
See application file for complete search history.

(56) References Cited

U.S. PATENT DOCUMENTS

| | | | | |
|---|---|---|---|---|
| 4,170,343 | A | 10/1979 | Longbrake | |
| 4,404,873 | A * | 9/1983 | Radish | B24D 15/06 76/82 |
| 4,441,279 | A * | 4/1984 | Storm | B24D 15/06 76/82.2 |
| 4,486,982 | A * | 12/1984 | Longbrake | B24D 15/06 76/82 |
| 4,936,053 | A * | 6/1990 | Shanelec | B24B 27/02 269/45 |
| 5,547,419 | A | 8/1996 | Hulnicki | |
| 2005/0048885 | A1* | 3/2005 | Longbrake | B24D 15/08 451/367 |
| 2012/0094582 | A1* | 4/2012 | Lytinas | B24B 3/54 451/64 |

OTHER PUBLICATIONS

The Crutch—Knife Sharpening Clamp—<URL: https://www.youtube.com/watch?v=Qg94PYCt_zl>, Published Oct. 4, 2018.
The Crutch—Knife Sharpening Clamp—<URL: https://www.youtube.com/watch?v=T55wzDVwaiw&t=288s>, Published Oct. 7, 2018.
Crutch Sharpening Guide by Konigsberg Sharpening—<URL: https://www.youtube.com/watch?v=TBdwchM8Tuc&t=11s>, Published Dec. 14, 2018.

(Continued)

*Primary Examiner* — Phong H Nguyen
(74) *Attorney, Agent, or Firm* — Carrier Blackman & Associates, P.C.; Joseph P. Carrier; William D. Blackman

(57) ABSTRACT

A blade sharpening device comprises a clamp for holding a blade in a fixed position relative to the device, an elongate slide member having a lower end adapted for sliding movement on a flat surface and an elongate support arm having a first end mechanically connected to the slide member. The elongate support arm extends at a fixed angle relative to the slide member and has a second end with the clamp provided thereon.

19 Claims, 6 Drawing Sheets

(56) References Cited

OTHER PUBLICATIONS

Knife Sharpener $8 Crutch for WATER Stones—<URL: https://www.thingiverse.com/thing:3563971/comments>, Published Apr. 15, 2019.
CASTLE Buffoon—Knife Sharpener—<URL: https://www.youtube.com/watch?v=PKJNHHajZps>, Published Dec. 13, 2018.

* cited by examiner

BLADE SHARPENER DEVICE

CROSS-REFERENCE TO RELATED APPLICATIONS

The present application claims priority under 35 USC 119 based on Australian Provisional Patent Application No. 2019902069, filed on Jun. 14, 2019. The entire subject matter of this priority document, including specification claims and drawings thereof, is incorporated by reference herein.

FIELD

The present invention relates to a handheld device for sharpening a blade and relates particularly, though not exclusively, to such a device for sharpening knives.

BACKGROUND

Traditionally chefs in restaurants and cooks in commercial kitchens use a variety of high-quality knives to cut and prepare food. When a knife loses its edge it may be sent to a professional sharpener who restores the cutting edge to its former sharpness. However, sometimes the knife is not sharpened as well as it could have been, and it no longer cuts as well as it did when it was new. Furthermore, knife sharpening is becoming less viable as a profession and fewer chefs and cooks are willing to spend the money on sharpening a high quality set of knives. They may prefer to simply buy less expensive knives and replace them more frequently when they lose their edge. Alternatively, some chefs and commercial cooks may prefer to sharpen their own knives as they can then maintain the kind of edge they prefer.

Various kinds of knife sharpening machines and devices are available, but these can be expensive and/or difficult to use to get a consistent edge on the knife while sharpening. Many of these known devices also have several moving parts and are difficult to maintain in good working order.

The present invention was developed with a view to providing a handheld knife sharpening device that is easy to use and will consistently provide a bevel at the knife edge of constant angle. Although the invention will be described with particular reference to knife sharpening, it will be understood that the device according to the invention may be used for sharpening many other kinds of blades, including scissor blades, shears, two blade and three blade arrow heads, etc.

References to known devices in this specification are provided for illustrative purposes only and are not to be taken as an admission that such known devices is part of the common general knowledge in Australia or elsewhere.

SUMMARY

According to the present invention, there is provided a blade sharpening device, comprising:

a clamp for holding a blade in a fixed position relative to the device;

an elongate slide member having a lower end adapted for sliding movement on a flat surface; and an elongate support arm having a first end mechanically connected to the slide member, extending at a fixed angle relative to the slide member, and having a second end with the clamp provided thereon.

The first end may be mechanically connected to the slide member by an adjustable connection wherein the angle of the support arm relative to the flat surface can be adjusted.

The adjustable connection may be configured to provide for continuous movement of the first end along a length of the slide member.

The adjustable connection may be a screw-threaded connection, so that the angle of the support arm relative to the flat surface can be varied by adjusting the screw-threaded connection.

The slide member may comprise a rod having a threaded section along the length, the threaded section being received in a threaded aperture provided at the first end of the support arm to form the screw-threaded connection.

The threaded section may be adjacent an upper end of the slide member.

A lock-nut may be provided on the threaded section for locking the support arm in position on the slide member.

The lower end of the slide member may be rounded to permit the lower end to slide smoothly on the flat surface.

The clamp may comprise a lower jaw and an upper jaw mounted above the lower jaw, wherein the lower jaw and the upper jaw are movable relative to each other between a loosened condition and a clamped condition.

The lower jaw may comprise a lower clamping surface and the upper jaw may comprise an upper clamping surface facing the lower clamping surface, the upper clamping surface and the lower clamping surface being adapted to hold a blade there between when the clamp is in the clamped condition.

The lower jaw may be provided with a step in the lower clamping surface adjacent an outer edge of the lower jaw, wherein an outer edge of the lower clamping surface contacts a blade held in the clamp.

The step may be formed with a wave along the outer edge of the lower clamping surface.

The clamp may further comprise an adjustable fastening mechanism for moving the upper jaw and the lower jaw relative to each other between the loosened condition and the clamped condition.

The adjustable fastening mechanism may comprise a screw-threaded fastening member which passes through an aperture provided in the upper jaw and is received in screw-threaded engagement with a screw-threaded aperture provided in the lower jaw.

The adjustable fastening mechanism may comprise a cam lock lever which is pivotally mounted on a fastener that passes through respective apertures in the lower jaw and the upper jaw, the cam lock lever having a cam surface adapted to bear downwardly on the upper jaw and being movable between a released position in which the clamp is in the loosened condition and a locked position in which the clamp is in the clamped condition.

The adjustable fastening mechanism may further comprise a bush interposed between the cam surface and an upper surface of the upper jaw.

The bush may comprise a concave upper section that receives the cam surface.

The clamp may further comprise a biaser for urging the upper jaw and the lower jaw toward the loosened condition.

The biaser may comprise a compression spring disposed between the upper jaw and the lower jaw.

The compression spring may comprise a conical compression spring.

BRIEF DESCRIPTION OF DRAWINGS

Embodiments of the invention will now be described by way of example only with reference to the accompanying drawings, in which.

DESCRIPTION OF EMBODIMENTS

Figure 1A:
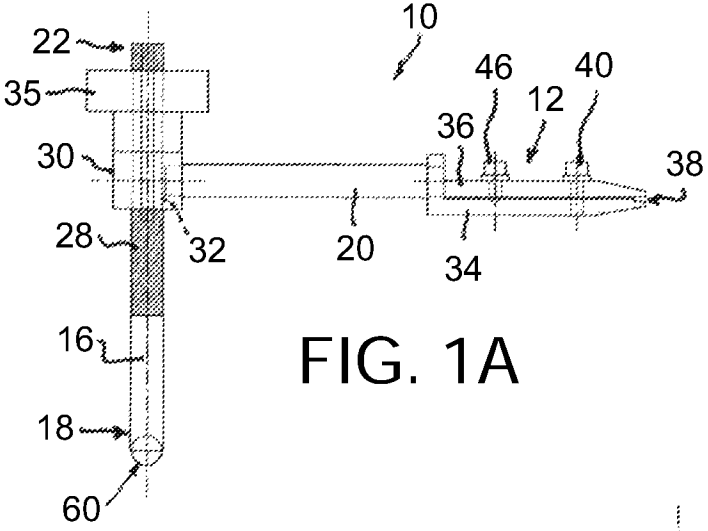
FIG. 1A is a side elevation of a blade sharpening device according to a first embodiment of the present invention.

Referring to FIGS. 1A to 1H, an example embodiment of the present invention provides a blade sharpening device 10 comprising a clamp 12 for holding a blade 14 (see FIG. 6) in a fixed position relative to the device 10. The device 10 further comprises an elongate slide member 16, having a lower end 18 adapted for sliding movement on a flat surface. An elongate support arm 20 has a first end mechanically connected to the slide member 16. The support arm 20 extends at a fixed angle relative to the slide member 16, and has a second end with the clamp 12 provided thereon.

Figure 6:
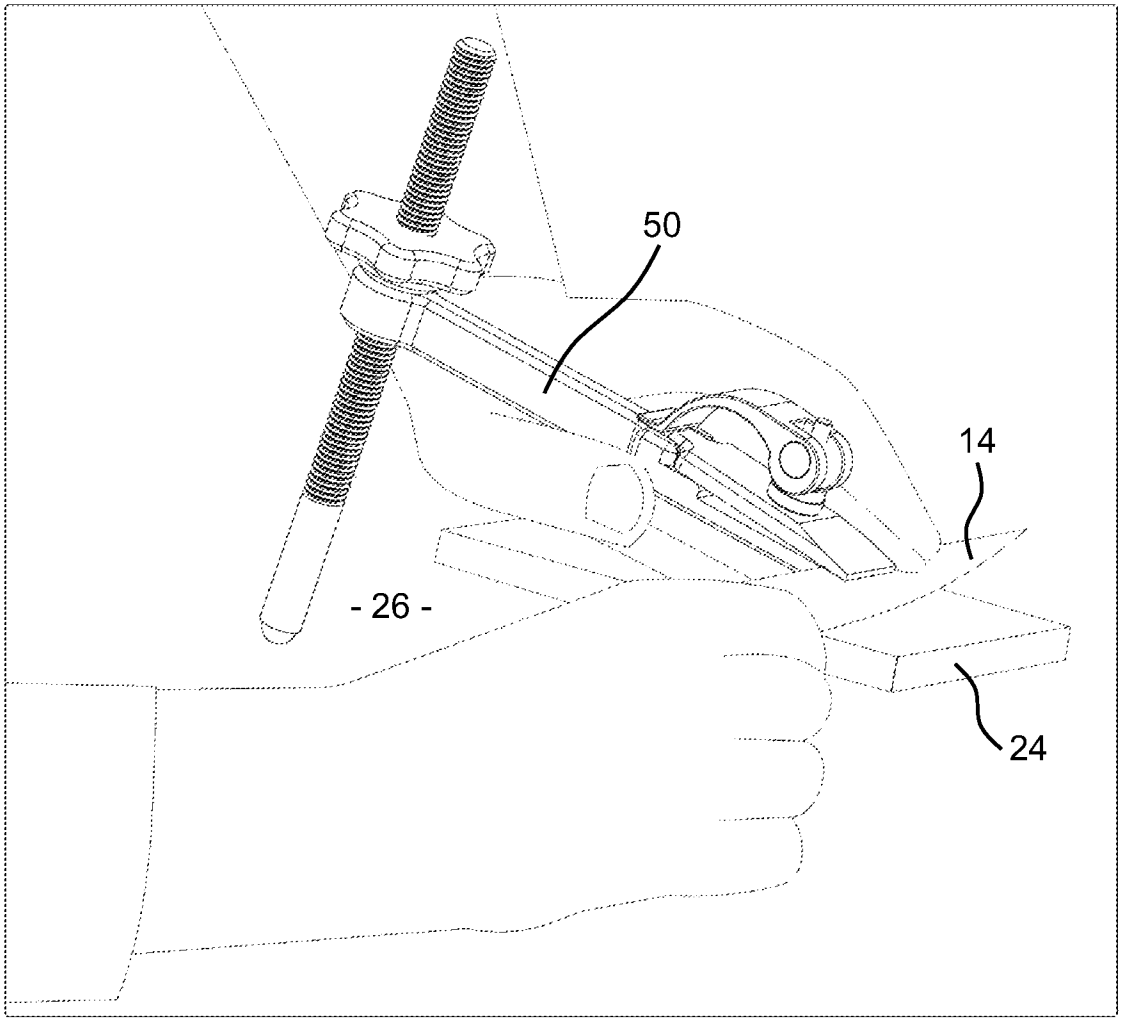
FIG. 6 illustrates the blade sharpening device of FIG. 2A being used to sharpen a knife blade.

Advantageously the blade sharpening device 10 is a handheld device which can be used for manually sharpening a blade 14 using a sharpening stone 24 (see FIG. 6). In use, one hand may be used to hold the knife 14. The other hand may be used to grip the device 10 with the fingertips of the other hand resting on the spine of the knife 14. Both hands are used to guide the device 10 and knife 14 across the surface of the sharpening stone 24 using a constant pressure. Both the sharpening stone 24 and the lower end 18 of the slide member 16 should be resting on the same flat surface 26, e.g. a table top. A back and forth sliding movement of the device 10 is then effected, with the edge of the blade 14 kept in contact with the surface of the sharpening stone 24, whilst the lower end 18 of the slide member 16 is kept in constant contact with the flat surface 26. This ensures that the edge of the blade 14 is being sharpened with a consistent angle bevel at all times.

Preferably the mechanical connection of the support arm 20 to the slide member 16 is an adjustable connection wherein the angle of the support arm 20 relative to the flat surface 26 can be adjusted. In the example depicted, the adjustable connection is a screw-threaded connection which advantageously provides for continuous movement of the first end of the support arm 20 along a length of the slide member 16. The angle of inclination of the support arm 20 relative to the flat surface 26 can be varied by adjusting the screw-threaded connection.

Preferably the slide member 16 comprises a rod, which has a threaded section 28 along its length adjacent an upper end 22 of the slide member. The threaded section 28 is received in a threaded aperture 32 provided at the first end of the support arm 20, to form the screw-threaded connection. In this embodiment, a height adjustment knuckle 30 is provided in screw-threaded connection with the support arm 20, and the threaded aperture 32 is provided in the height adjustment knuckle 30. Advantageously a lock-nut 35 (see FIGS. 1G and 1H) is also provided on the threaded section 28 of the slide member 16 for locking the support arm 20 in position on the slide member 16 after adjustment. Adjusting the height of the support arm 20 on the threaded section 28 of the slide member 16 also adjusts the angle of inclination of the support arm 20 relative to the flat surface 26, and hence of the edge of blade 14, held in clamp 12, on the surface of the sharpening stone 24.

Figure 1B:
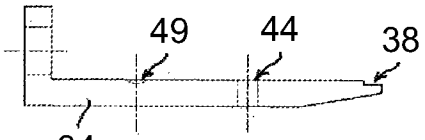
FIG. 1B is a side elevation of a lower jaw of a clamp employed in the blade sharpening device of FIG. 1A.
Figure 1C:
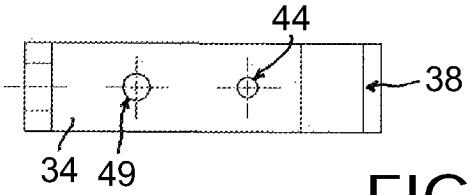
FIG. 1C is a top plan view of the lower jaw of FIG. 1B.
Figure 1D:
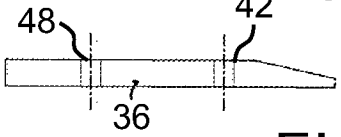
FIG. 1D is a side elevation of an upper jaw of the clamp of the blade sharpening device of FIG. 1A.
Figure 1E:
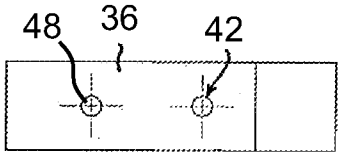
FIG. 1E is a top plan view of the upper jaw of FIG. 1D.
Figure 1F:
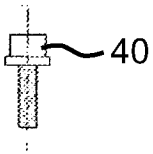
FIG. 1F is a side elevation of a fastening member employed in the clamp of the blade sharpening device of FIG. 1A.
Figure 1G:
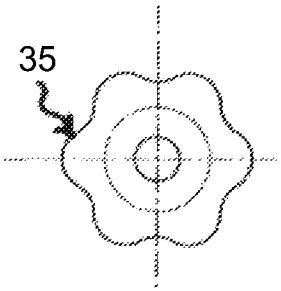
FIG. 1G is top plan view of a height adjustment lock nut employed in the blade sharpening device of FIG. 1A.
Figure 1H:
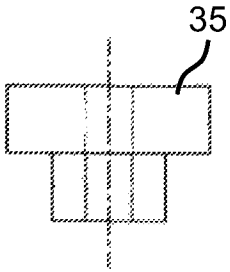
FIG. 1H is a side elevation of the height adjustment lock nut of FIG. 1G.

In this embodiment, the clamp 12 comprises a lower jaw 34 and an upper jaw 36 mounted above the lower jaw 34. The pair of jaws 34, 36 are configured for relative movement between a loosened condition and a clamped condition. In the example depicted, the lower jaw 34 is fixed to the second end of the support arm 20 and the upper jaw 36 is mounted above the lower jaw 34 and is movable between the loosened condition and the clamped condition. Preferably the lower jaw 34 has a lower clamping surface and the upper jaw 36 has an upper clamping surface which faces the lower clamping surface, the upper clamping surface and the lower clamping surface being adapted to hold a blade 14 firmly there between when the upper jaw 36 is in the clamped condition. In this embodiment, the lower jaw 34 is L-shaped when viewed in elevation, as shown in FIG. 1B, and a vertical part of the lower jaw is adapted to be connected to the second end of the support arm 20 with a screw-threaded connection.

Preferably the lower jaw 34 is formed with a step 38 in the lower clamping surface, adjacent an outer edge of the lower jaw 34, wherein the outer edge of the lower clamping surface contacts a blade 14 held in the clamp 12. The purpose of step 38 is to enable blades of various sizes to be held more securely in the clamp 12. The spine of a blade 14 can be abutted against the edge of step 38, which therefore acts as an indexing edge, ensuring that the extent to which the edge of the blade 14 protrudes beyond the outer edge of the lower jaw 34 remains constant during sharpening. When the blade is turned over, the spine can again be aligned with the edge of step 38 to maintain a constant overhang of the blade beyond the outer edge of the lower jaw 34, and therefore of the clamp 12. This is crucial to reproduce a consistent double or single bevel angle to a prescribed angle at the knife edge.

Preferably the clamp 12 further comprises an adjustable fastening mechanism for moving the upper jaw 36 relative to the lower jaw 34 between the loosened position and the clamped position. In this embodiment, the adjustable fastening mechanism comprises a first screw-threaded fastening member 40 which passes through a first aperture 42 provided in the upper jaw 36 and is received in screw-threaded engagement with a screw-threaded aperture 44 provided in the lower jaw 34. The adjustable fastening mechanism further comprises a second screw-threaded fastening member 46 which is received in a second screw-threaded aperture 48 provided in the upper jaw 36. This second screw-threaded fastening member 46 engages with a positioning divit 49 provided in the lower jaw 34—see FIGS. 1B and 1C. Either one or both of the first and second screw-threaded fastening members 40, 46 can be tightened or loosened to move the upper jaw 36 relative to the lower jaw 34 between the loosened position and the clamped position.

Preferably the lower end 18 of the slide member 16 is adapted for sliding movement on a flat surface 26. The lower end 18 may be rounded to minimise friction and provide for smooth movement of the lower end 18 across the surface 26. In the embodiment, the lower end 18 comprises a ball bearing 60 received by friction press fit in an aperture provided for this purpose in the lower end 18.

Figure 2B:
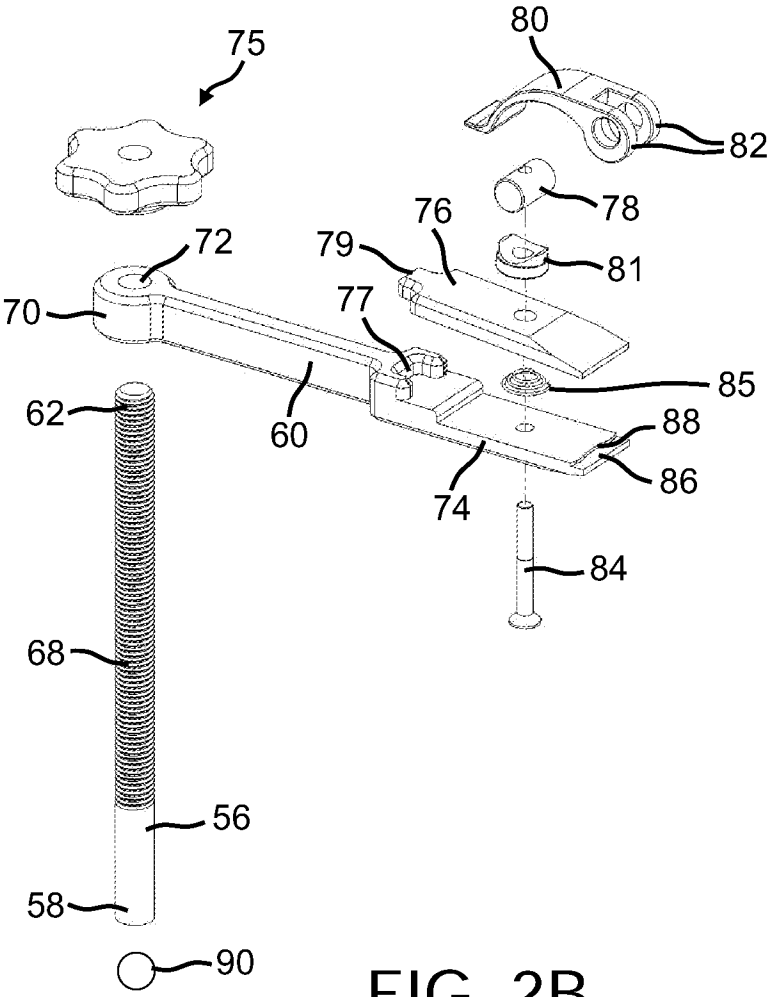
FIG. 2B is an exploded isometric view of the blade sharpening device of FIG. 2A.
Figure 2A:
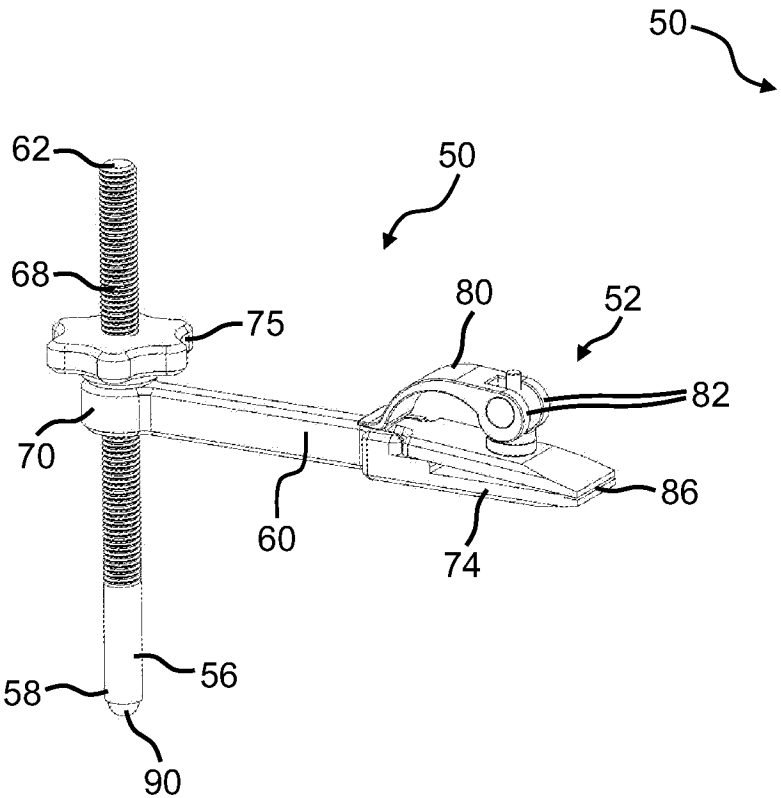
FIG. 2A is an isometric view of a blade sharpening device according to a second embodiment of the present invention.

A second embodiment of a blade sharpening device 50 in accordance with the present invention will now be described with reference to FIGS. 2A and 2B and FIG. 3. The blade sharpening device 50 is similar to the previous embodiment and comprises a clamp 52 for holding a blade 14 (see FIG. 6) in a fixed position relative to the device 50. The device 50 further comprises an elongate slide member 56, having a lower end 58 adapted for sliding movement on a flat surface 26. An elongate support arm 60 has a first end mechanically connected to the slide member 56. The support arm 60 extends at a fixed angle relative to the slide member 56, and has a second end with the clamp 52 provided thereon.

As with the first embodiment, the slide member 56 comprises a rod, which has a threaded section 68 along its length adjacent an upper end 62 of the slide member 56. The threaded section 68 is received in a threaded aperture 72 provided at the first end of the support arm 60, to form the screw-threaded connection. In this embodiment, a height adjustment knuckle 70 is provided integral with the support arm 60, and the threaded aperture 72 is provided in the height adjustment knuckle 70. Advantageously a lock-nut 75 is also provided on the threaded section 68 of the slide member 56 for locking the support arm 60 in position on the slide member 56, after adjustment. Adjusting the height of the support arm 60 on the threaded section 68 of the slide member 56 also adjusts the angle of inclination of the support arm 60 relative to the flat surface 26, and hence of the edge of blade 14, held in clamp 52, on the surface of the sharpening stone 24.

In this embodiment, the clamp 52 comprises a lower jaw 74 which is provided integral with the second end of the support arm 60, and an upper jaw 76 which is mounted above the lower jaw 74 and is movable relative to the lower jaw 74 between a loosened condition and a clamped condition. Preferably a rearmost end of the upper jaw 76 is adapted to pivot about an axis extending transversely to the longitudinal length of the lower jaw 74. More particularly, a rearmost end of the lower jaw 74 adjacent the second end of the support arm 60 comprises an upwardly extending wall that has an inwardly extending cavity 77. The cavity 77 receives a tapered end portion 79 of the upper jaw 76 and provides a fulcrum about which the upper jaw 76 may pivot relative to the lower jaw 74. The cavity 77 and end portion 79 are preferably shaped complementary to one another such that the cavity 77 governs and constrains the movement of the upper jaw 76 about the pivotal axis.

Preferably the lower jaw 74 has a lower clamping surface and the upper jaw 76 has an upper clamping surface which faces the lower clamping surface, the upper clamping surface and the lower clamping surface being adapted to hold a blade 14 firmly there between when the upper jaw 76 is in the clamped condition. Preferably the clamp 52 further comprises an adjustable fastening mechanism for moving the upper jaw 76 relative to the lower jaw 74 between the loosened position and the clamped position. In this embodiment, the adjustable fastening mechanism comprises a cam lock lever 80 which is pivotally mounted on a hub 78. A bush 81 is interposed between the upper surface of the upper jaw 76 and the hub 78 and lever 80. The hub 78 is held by a screw-threaded fastener 84 that passes through respective apertures in the lower jaw 74, upper jaw 76 and bush 81. The cam lock lever 80 has a cam surface 82 that is received by a concave upper section of the bush 81. When the cam lock lever 80 is moved towards a locked position, as depicted in FIGS. 2A and 3, the cam surface 82 bears downwardly on the bush 81 and upper jaw 76 thereby urging the upper jaw 76 towards the clamped position.

The adjustable fastening mechanism may also comprise a biaser 85 for urging the upper jaw 76 and lower jaw 74 apart from one another when the cam lock lever 80 is moved towards a released position, thus moving the upper jaw 76 towards the loosened position. In the example depicted, the biaser comprises a compression spring 85 disposed between the lower jaw 74 and the upper jaw 76. The compression spring 85 is a conical compression spring wherein a radius of curvature of its coiled wire member tapers along its length. The compression spring 85 is advantageously operable when compressed by the upper and lower clamping surfaces when the upper jaw 76 is in the clamped position.

As with the first embodiment, the lower jaw 74 is preferably formed with a step 86 in the lower clamping surface adjacent an outer edge of the lower jaw 74, wherein the outer edge of the lower clamping surface contacts a blade 14 held in the clamp 52. As with the step 38 in the first embodiment, step 86 is to enable blades of various sizes to be held more securely in the clamp 52. The spine of a blade 14 can be abutted against the edge of step 86, which therefore acts as an indexing edge, ensuring that the extent to which the edge of the blade 14 protrudes beyond the outer edge of the lower jaw 74 remains constant during sharpening. Advantageously the step 86 is formed with a wave 88 along its outer edge to provide an improved grip on some kinds of knives. For example, some knives are formed with a convex curved spine, and the edge of the convex spine can be received in a central concave portion of the wave 88 to hold the curved spine more securely in the clamp 52. Knives with a concave curved spine can likewise be abutted and therefore held more securely against the convex portions of the wave 88.

As with the first embodiment, the lower end 58 of slide member 56 is adapted for sliding movement on a flat surface 26. The lower end 58 is provided with a ball bearing 90, received by friction press fit in an aperture provided for this purpose in the lower end 58 of the slide member 56. The ball bearing 90 permits the lower end 58 of the slide member 56 to move smoothly across the flat surface 26 with minimal friction.

Figure 3:
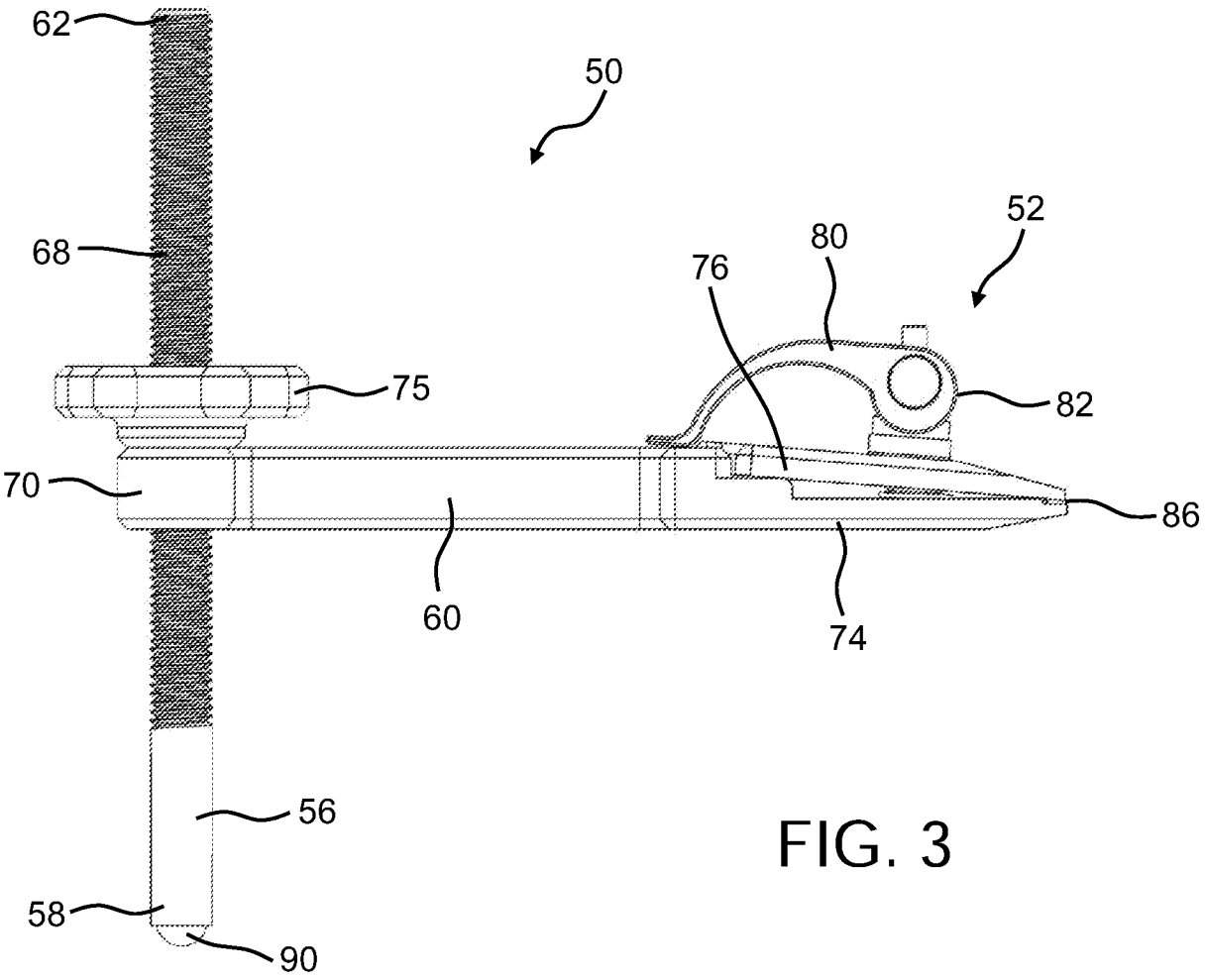
FIG. 3 is a side elevation of the blade sharpening device of FIG. 2A.
Figure 4B:
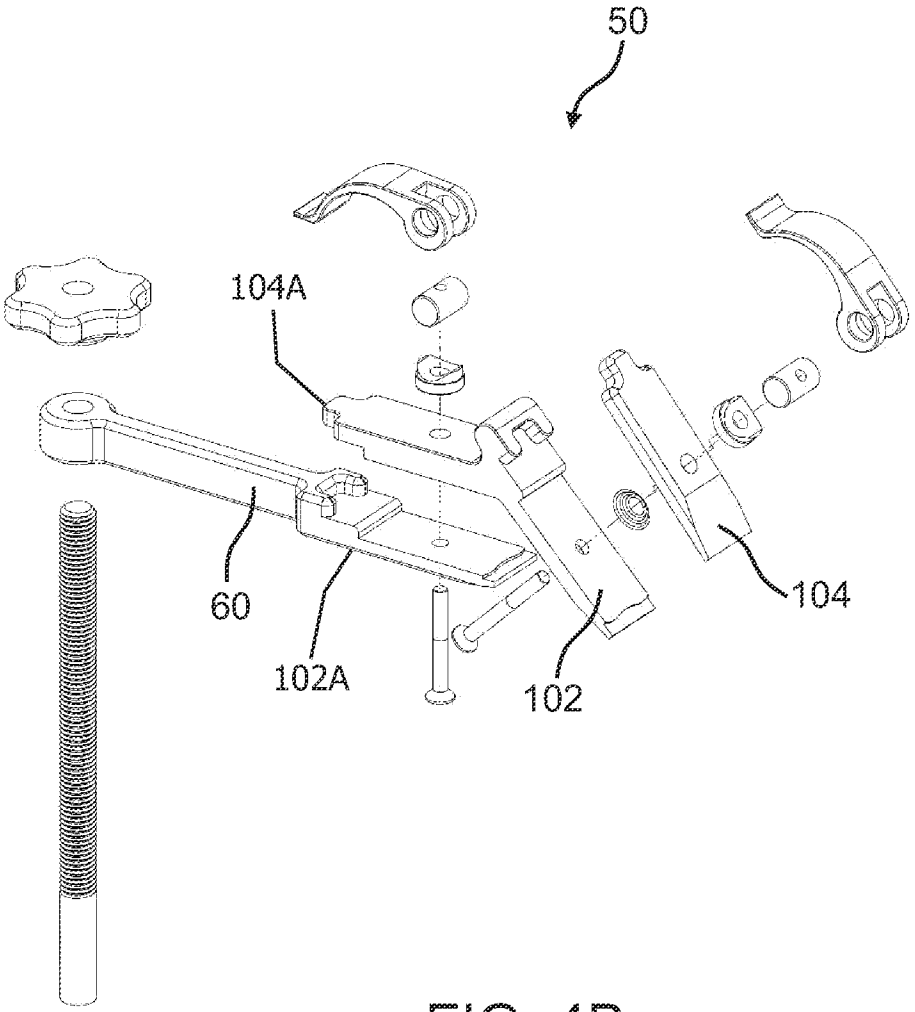
FIG. 4B is an exploded isometric view of the blade sharpening device and scissor attachment of FIG. 4A.
Figure 4A:
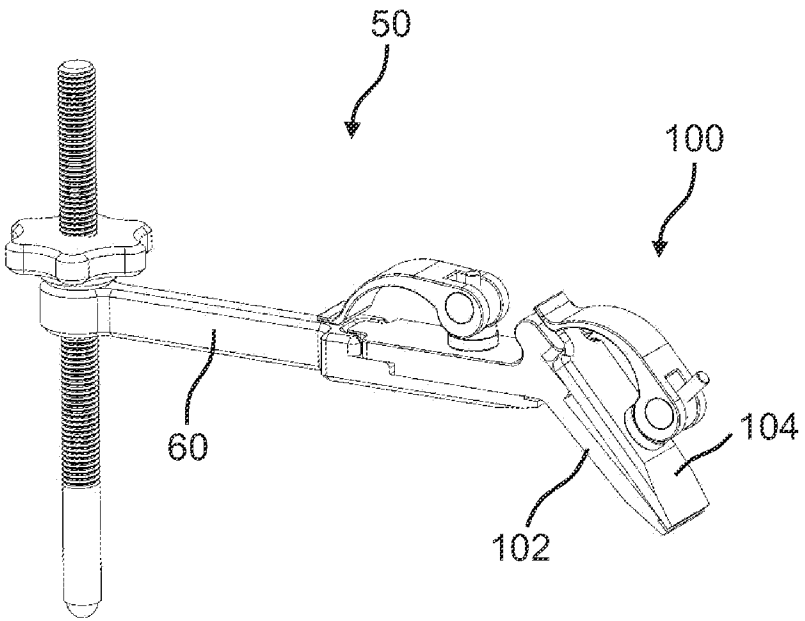
FIG. 4A is an isometric view of the blade sharpening device of FIG. 2A shown with a scissor attachment.
Figure 5:
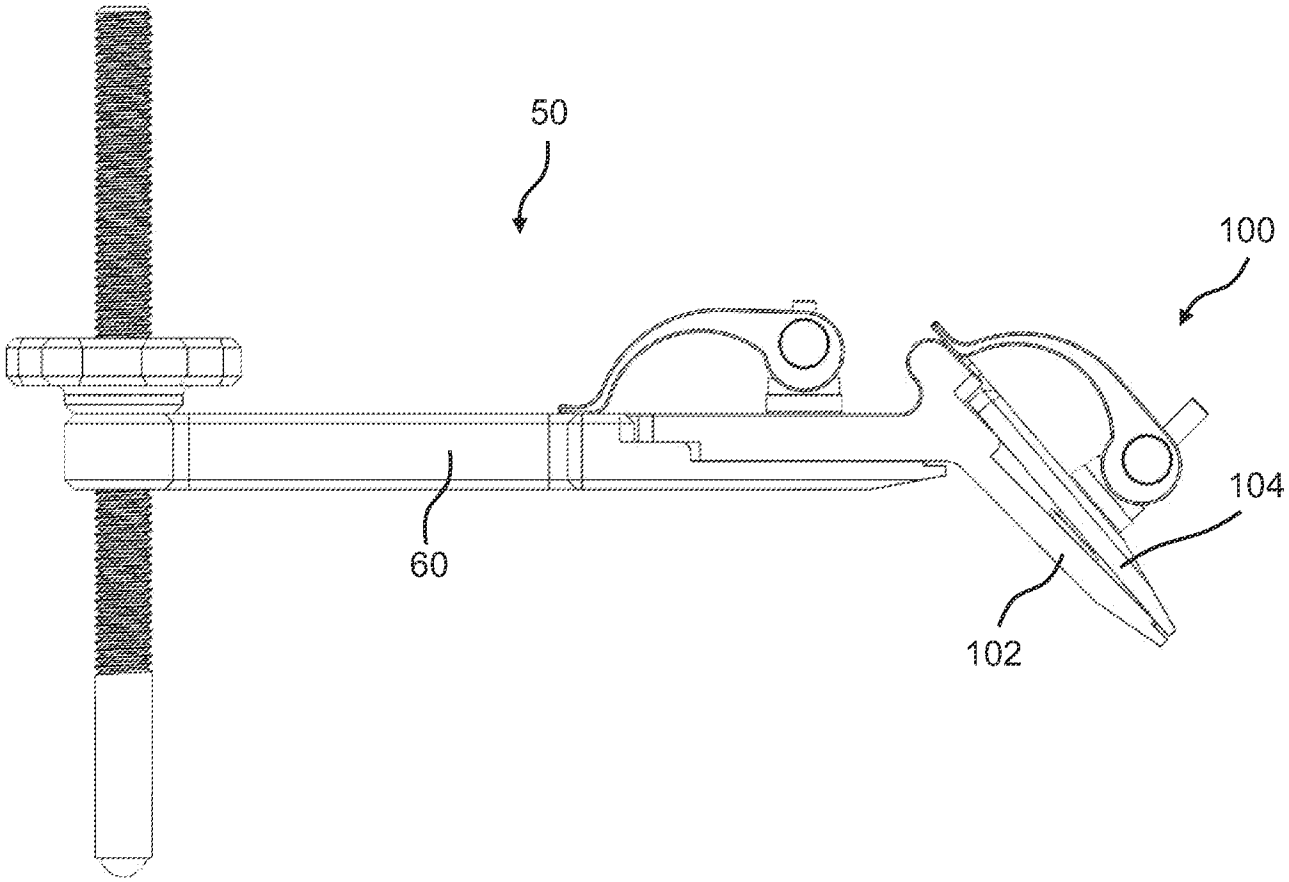
FIG. 5 is a side elevation of the blade sharpening device and scissor attachment of FIG. 4A.

Advantageously, the clamps 12, 52 that are provided in the examples depicted in FIGS. 1 to 3 may be replaced with a different kind of clamp for holding another type of blade. For example, in FIGS. 4A and 4B and FIG. 5 the blade sharpening device 50 is shown with a scissor clamp 100 for holding a scissor blade in a fixed position relative to the device 50. The scissor clamp 100 also comprises a lower jaw 102, and an upper jaw 104 which is mounted above the lower jaw 102 and is movable relative to the lower jaw 102 between a loosened condition and a clamped condition. However, in this embodiment the lower and upper jaws 102, 104 are angled relative to the support arm 60, and are adapted to hold the scissor blade in the clamped condition.

The lower jaw 102 further is connected to the support arm 60 through a second clamp having an upper jaw 104A and a lower jaw 102A.

In other respects the device 50 with scissor clamp 100 attached is similar in configuration and operation to the device 50 with knife clamp 52 attached as described above, and will not be described again in detail here.

Now that example embodiments of the blade sharpening device have been described, it will be apparent that it provides a number of advantages over the known devices, including the following:

(i) It is simple in design, easy to use, robust and reliable;
(ii) Infinite adjustability of the applied angle within the range of the tool;
(iii) Able to reproduce a consistent double or single bevel angle to a prescribed angle;
(iv) No moving parts while in use;
(v) Can be used on any flat firm surface, using own sharpening media (e.g., whetstone);
(vi) Readily adaptable to be used for a broad variety of blades, including knives, scissors, shears, two blade and three blade arrowheads, etc.;
(vii) It is lightweight, compact and portable;
(viii) Practically maintenance-free except for routine cleaning;
(ix) Handheld and manual operation (no power required);
(x) Unique wave in gripping jaw provides improved grip on "professional" knives having blades with curved spines;
(xi) Cam lock on clamp to increase clamp force applied.

It will be readily apparent to persons skilled in the relevant art that various modifications and improvements may be made to the foregoing embodiments, in addition to those already described, without departing from the basic inventive concepts of the present invention. For example, although the simplicity of the handheld blade sharpening device as a stand-alone device is particularly attractive, it could be readily incorporated into an integrated blade sharpening apparatus comprising a sharpening media and a slide surface, on which the lower end of the slide member is adapted to slide.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the words "preferably", including variations such as "preferred", and "may" will be understood to imply that a stated integer or group of integers is desirable but not essential to the working of the invention.

The above embodiments have been described by way of example only and modifications are possible within the scope of the claims that follow.

What is claimed is:

1. A blade sharpening device, comprising:

a first clamp for holding a blade in a fixed position relative to the device, wherein the first clamp comprises a lower jaw and an upper jaw mounted above the lower jaw, wherein the lower jaw and the upper jaw are movable relative to each other between a loosened condition and a clamped condition;

an elongate slide member having a lower end adapted for sliding movement on a flat surface;

an elongate support arm having a first end mechanically connected to the slide member, extending at a fixed angle relative to the slide member, and a second end, and wherein the lower jaw and the upper jaw of the first clamp are angled relative to the support arm; and a second clamp that is attachable to the second end, wherein the second clamp comprises a lower jaw and an upper jaw mounted above the lower jaw of the second clamp, wherein the lower jaw and the upper jaw of the second clamp are movable relative to each other between a loosened condition and a clamped condition and, wherein the upper jaw of the second clamp is integral with the lower jaw of the first clamp; and wherein the second end of the elongate support arm is provided with the second clamp.

2. The blade sharpening device according to claim 1, wherein the first end is mechanically connected to the slide member by an adjustable connection wherein the angle of the support arm relative to the flat surface can be adjusted.

3. The blade sharpening device according to claim 2, wherein the adjustable connection is configured to provide for continuous movement of the first end along a length of the slide member.

4. The blade sharpening device according to claim 3, wherein the adjustable connection is a screw-threaded connection, so that the angle of the support arm relative to the flat surface can be varied by adjusting the screw-threaded connection.

5. The blade sharpening device according to claim 4, wherein the slide member comprises a rod having a threaded section along the length, the threaded section being received in a threaded aperture provided at the first end of the support arm to form the screw-threaded connection.

6. The blade sharpening device according to claim 5, wherein the threaded section is adjacent an upper end of the slide member.

7. The blade sharpening device according to claim 6, wherein a lock-nut is provided on the threaded section for locking the support arm in position on the slide member.

8. The blade sharpening device according to claim 1, wherein the lower end of the slide member is rounded to permit the lower end to slide smoothly on the flat surface.

9. The blade sharpening device according to claim 1, wherein the lower jaw of the first clamp has a lower clamping surface and the upper jaw of the first clamp has an upper clamping surface facing the lower clamping surface, the upper clamping surface and the lower clamping surface being adapted to hold a blade there between when the first clamp is in the clamped condition.

10. The blade sharpening device according to claim 9, wherein the lower jaw of the first clamp is provided with a step in the lower clamping surface adjacent an outer edge of the lower jaw of the first clamp, wherein an outer edge of the lower clamping surface contacts a blade held in the first clamp.

11. The blade sharpening device according to claim 10, wherein the step is formed with a wave along the outer edge of the lower clamping surface.

12. The blade sharpening device according to claim 1, wherein the first clamp further comprises an adjustable fastening mechanism for moving the upper jaw and the lower jaw of the first clamp relative to each other between the loosened condition and the clamped condition of the first clamp.

13. The blade sharpening device according to claim 12, wherein the adjustable fastening mechanism comprises a screw-threaded fastening member which passes through an aperture provided in the upper jaw of the first clamp and is received in screw-threaded engagement with a screw-threaded aperture provided in the lower jaw of the first clamp.

14. The blade sharpening device according to claim 12, wherein the adjustable fastening mechanism comprises a cam lock lever which is pivotally mounted on a fastener that passes through respective apertures in the lower jaw and the upper jaw of the first clamp, the cam lock lever having a cam surface adapted to bear downwardly on the upper jaw of the first clamp and being movable between a released position in which the first clamp is in the loosened condition and a locked position in which the first clamp is in the clamped condition.

15. The blade sharpening device according to claim 14, wherein the adjustable fastening mechanism further comprises a bush interposed between the cam surface and an upper surface of the upper jaw of the first clamp.

16. The blade sharpening device according to claim 15, wherein the bush comprises a concave upper section that receives the cam surface.

17. The blade sharpening device according to claim 1, wherein the first clamp further comprises a biaser for urging the upper jaw and the lower jaw of the first clamp toward the loosened condition.

18. The blade sharpening device according to claim 17, wherein the biaser comprises a compression spring disposed between the upper jaw and the lower jaw of the first clamp.

19. The blade sharpening device according to claim 1, wherein the second clamp is releasably attachable to a part of the first clamp.

* * * * *